United States Patent [19]

Touho et al.

[11] 4,434,385

[45] Feb. 28, 1984

[54] DISCHARGE LAMP DEVICE

[75] Inventors: Makoto Touho, Yawata; Shigeaki Wada, Osaka; Minoru Yamamoto, Neyagawa, all of Japan

[73] Assignee: Matsushita Electric Works, Ltd., Osaka, Japan

[21] Appl. No.: 276,455

[22] Filed: Jun. 23, 1981

[30] Foreign Application Priority Data

| | | | |
|---|---|---|---|
| Jun. 30, 1980 | [JP] | Japan | 55-89391 |
| Jun. 30, 1980 | [JP] | Japan | 55-89395 |
| Jan. 17, 1981 | [JP] | Japan | 56-5430 |

[51] Int. Cl.[3] ..... H01J 1/50; F21V 9/16; F21M 3/14; H01R 39/00

[52] U.S. Cl. ..... 313/161; 313/485; 313/111; 362/84; 362/217; 362/255; 339/1 L

[58] Field of Search ..... 313/161, 485, 204, 111, 313/489, 609-612; 315/344; 362/84, 255, 219; 339/12 L, 1 L

[56] References Cited

U.S. PATENT DOCUMENTS

| | | | |
|---|---|---|---|
| 749,791 | 1/1904 | Hewitt | 313/161 X |
| 1,935,294 | 11/1933 | Jacquelet et al. | 315/344 |
| 2,299,720 | 10/1942 | Holman | 313/489 |
| 3,290,538 | 12/1966 | Larson et al. | 313/204 |
| 3,676,728 | 7/1972 | Schreurs | 313/111 X |
| 4,079,288 | 3/1978 | Maloney et al. | 313/489 |
| 4,341,979 | 7/1982 | Gross et al. | 313/161 X |

*Primary Examiner*—Palmer C. Demeo
*Assistant Examiner*—Sandra L. O'Shea
*Attorney, Agent, or Firm*—Burns, Doane, Swecker & Mathis

[57] ABSTRACT

A discharge lamp device wherein discharging zone within a tubular discharge lamp is caused to exist as selectively biased with respect to the axis of the lamp to render the light distributing characteristic non-uniform in the circumferential direction of the lamp and, utilizing such biased discharging zone, a light of selective color or color tone dependent on a color or color tone determining material disposed along the biased zone is provided. The discharging zone biasing is realized specifically preferably by an electromagnetic means.

31 Claims, 47 Drawing Figures

DISCHARGE LAMP DEVICE

This invention relates to discharge lamp devices and, more particularly, to a discharge lamp device which enables either one of the light distributing direction and the color or its tone of the light or even both of them to be varied as desired.

In order to obtain a specific light distributing characteristic biased only in a desired direction by rendering the light distributing direction of the discharge lamp device to be non-uniform, it has been general that a reflective film is formed on the inside surface of a glass tube in all circumferential directions but a part of the desired direction and a fluorescent film is formed on the entire inside surface of the reflctive film and glass tube at the part having no film, so that the specific light distributing characteristic can be achieved. Otherwise, a light reflector has been disposed partly around the lamp tube so that the specific characteristic will be obtained depending on disposed direction of the reflector relative to the lamp tube. However, there have been involved in these devices such difficulties that, as the light is absorbed by the reflecting film or reflector, the light emitting efficiency is reduced and that the freedom of varying the light distributing direction cannot be well improved as the light emitting direction itself has not been varied.

Further, in order to vary the color or its tone (which shall be referred to simply as "color" hereinafter) of emitted light by the discharge lamp device, circumferentially divided portions of the inside surface of the lamp tube have been painted respectively with each of different fluorescent materials, in combination with the foregoing arrangements, so that a color inherent to the fluorescent material positioned in the desired illuminating direction has been obtained. With this measure, however, there has been a defect that the light emission with the other fluorescent material or materials than an intended material and positioned on the side substantially opposite to the desired direction is also given to the light emitted in the desired direction and it has been very difficult to adjust the color. It has been also suggested to selectively vary the color by means of differently colored filters disposed around the lamp tube but, in this case, too, the intended color variation has been practically very difficult to achieve effectively.

With the conventional discharge lamp devices, further, the light distributing direction and color have not been able to be simultaneously selectively varied.

A primary object of the present invention is, therefore, to provide a discharge lamp device wherein either the light distributing direction or color can be varied effectively as desired.

Another object of the present invention is to provide a discharge lamp device wherein the light distributing direction or color can be varied as desired while avoiding the reduction of the light emitting efficiency of the device.

A further object of the present invention is to provide a discharge lamp device wherein both of the light distributing direction and color can be varied as desired without reducing the light emitting efficiency.

Other objects and advantages of the present invention shall become clear from the following descriptions of the invention detailed with reference to preferred embodiments shown in accompanying drawings, in which.

Figure 1:
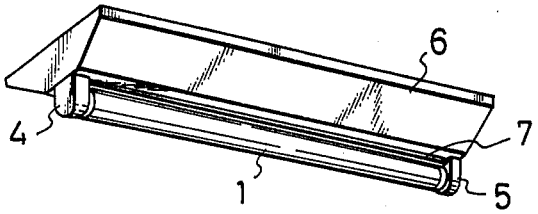
FIG. 1 is a perspective view of a first embodiment of the present invention wherein a permanent magnet is employed as fixed while lamp tube is made axially rotatable.
Figure 2:
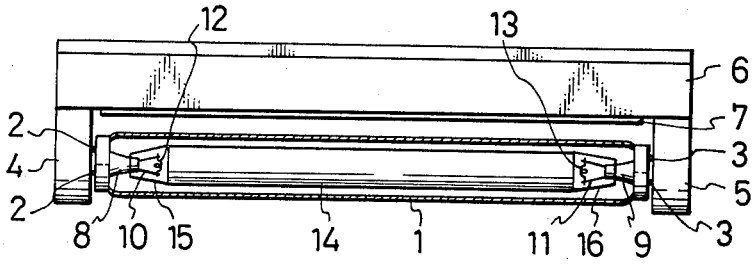
FIG. 2 is a sectioned elevation of the first embodiment of FIG. 1.
Figure 5:
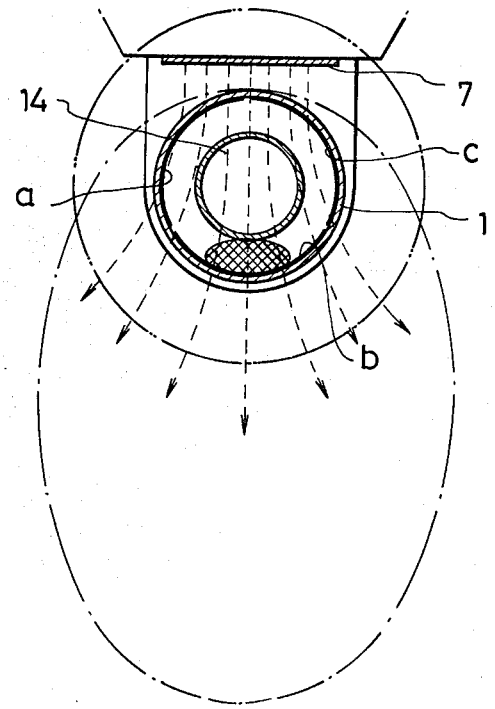
Figure 6:
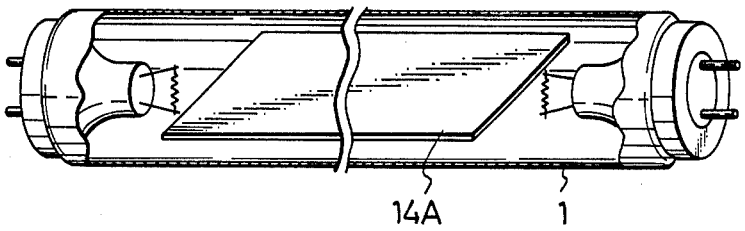
Figure 7:
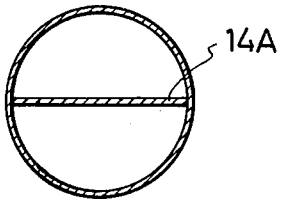
Figure 8:
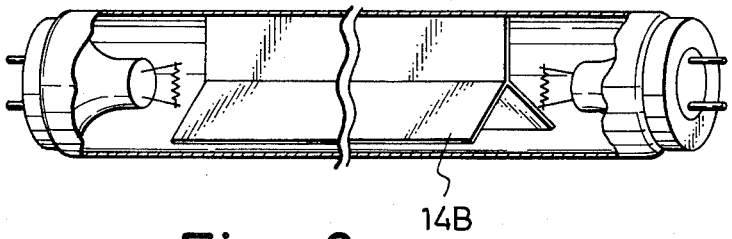
Figure 9:
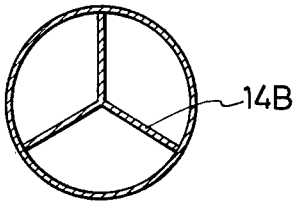
Figure 10:
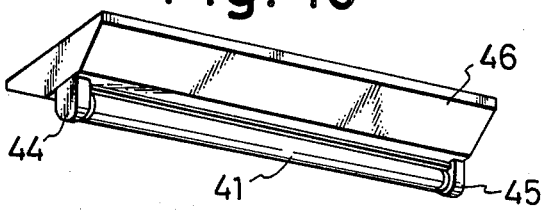
Figure 11:
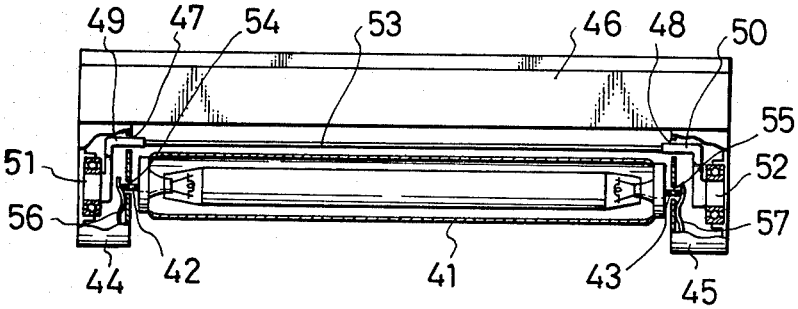
Figure 12:
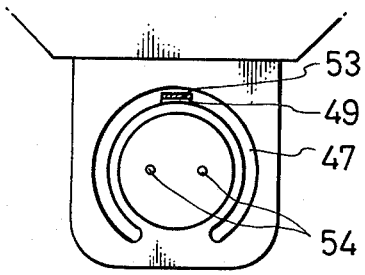
Figure 13A:
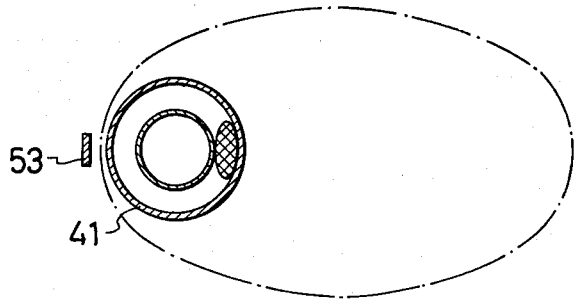
Figure 13B:
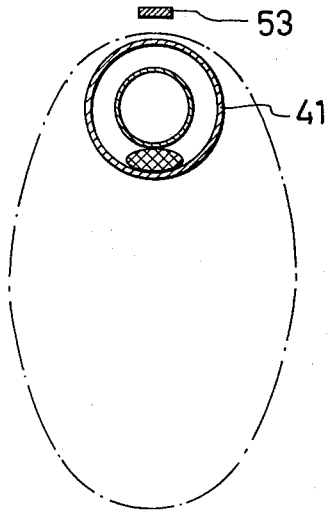
Figure 13C:
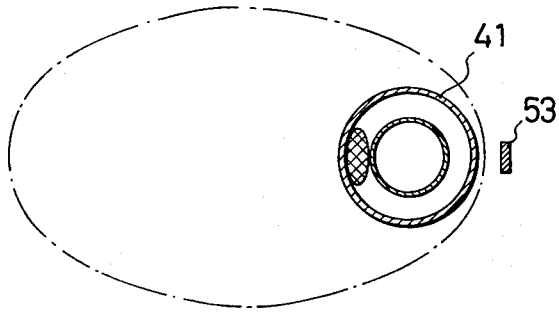
Figure 14:
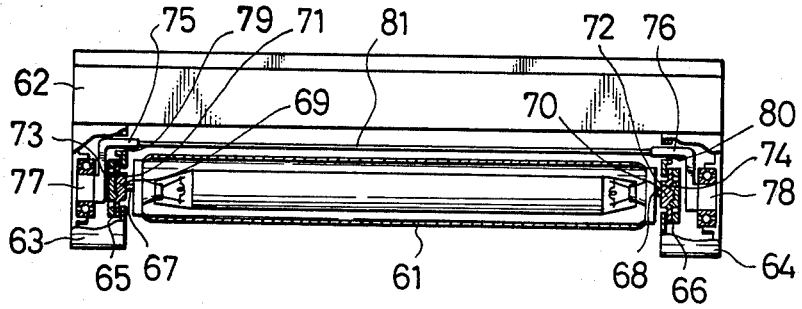
Figure 15:
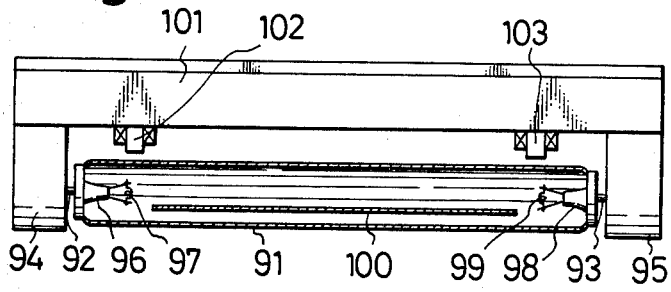
Figure 16:
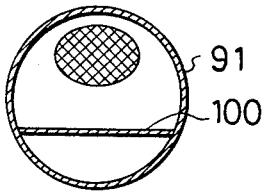
Figure 17:
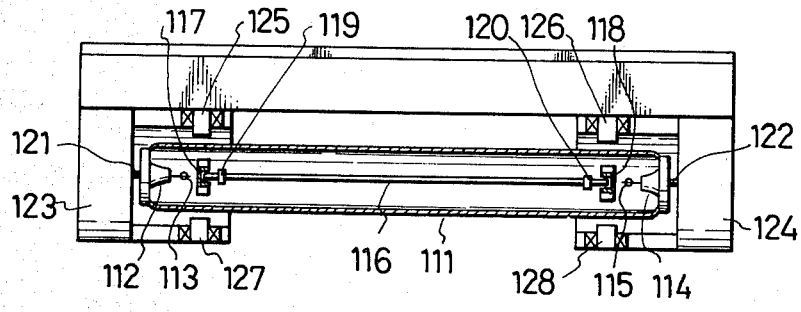
Figure 19:
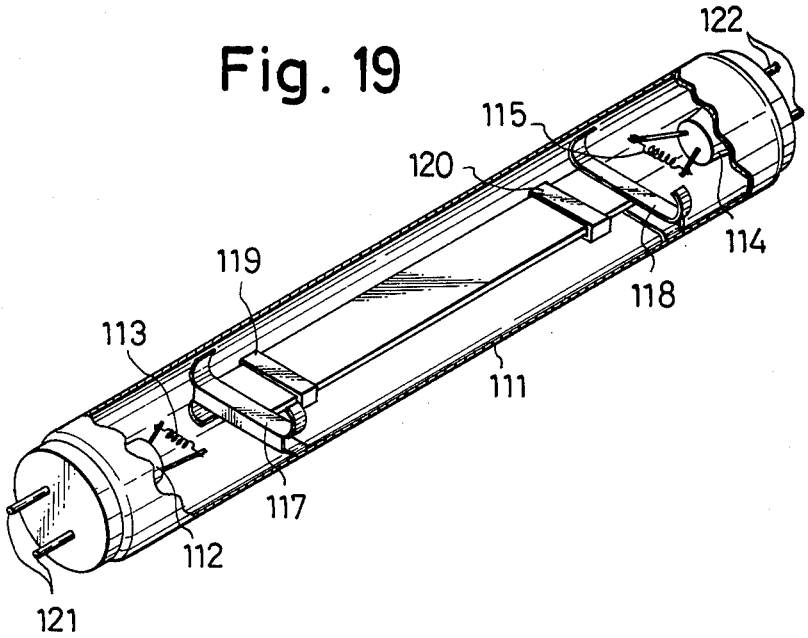
Figure 18:
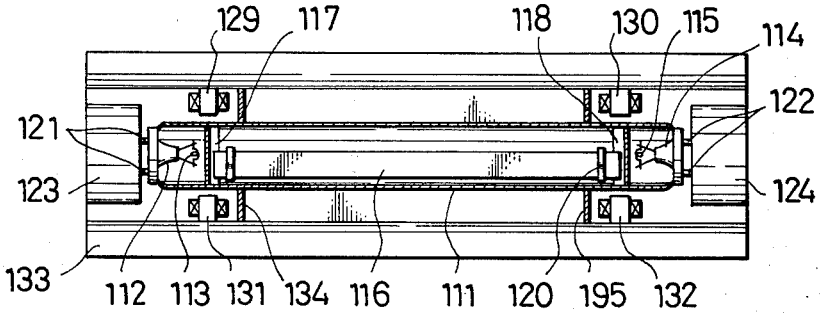
Figure 21:
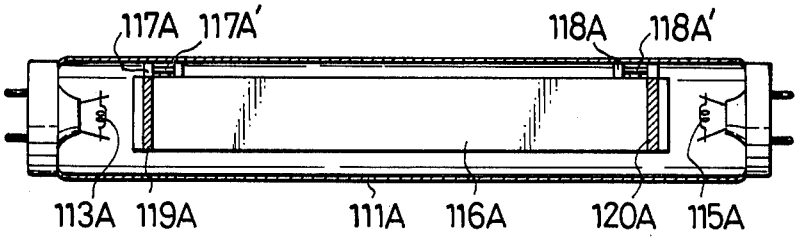
Figure 22:
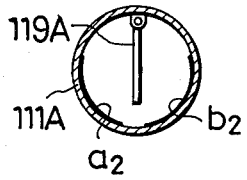
Figure 23A:
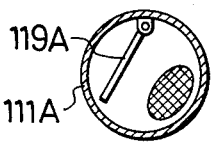
Figure 23B:
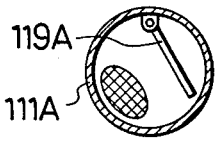
Figure 24:
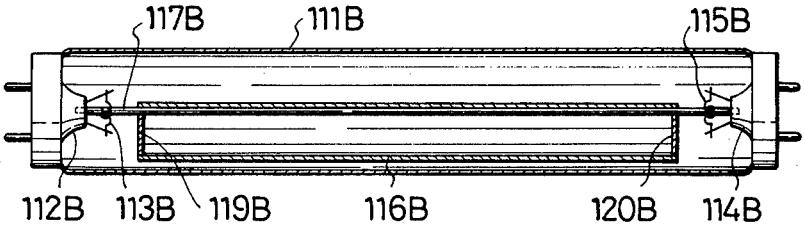
Figure 25:
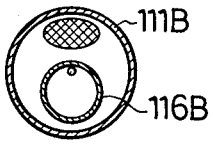
Figure 26A:
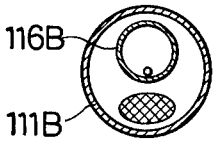
Figure 26B:
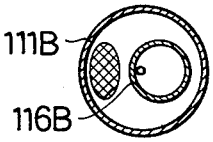
Figure 27:
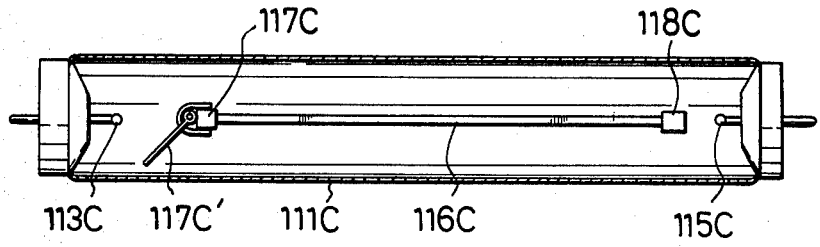
Figure 28:
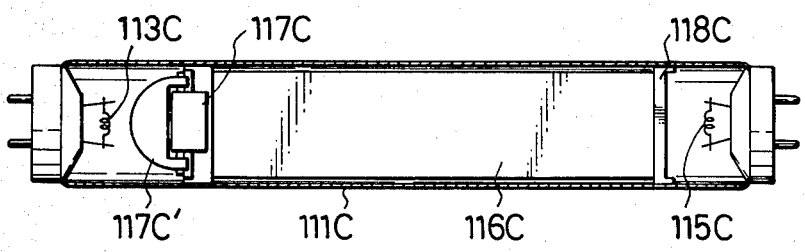
Figure 31:
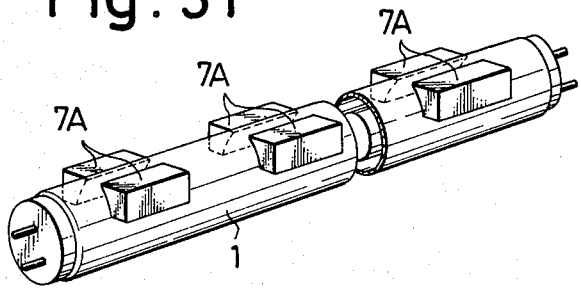
Figure 29:
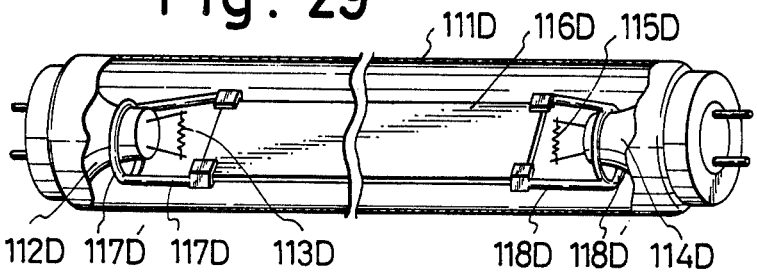
Figure 32:
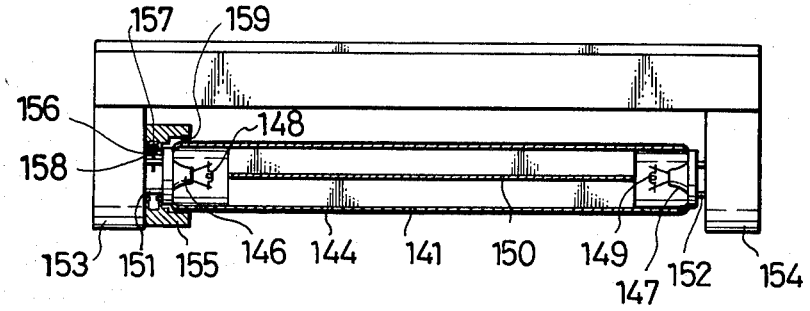
Figure 33:
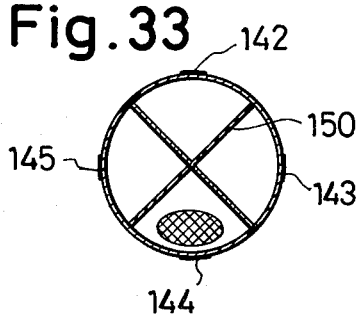

FIG. 5 is a schematic sectioned view of the lamp device of the first embodiment as shown in a plane intersecting at right angles the axis of lamp tube wherein a cross-hatched portion indicates a discharging zone and a single-dotted chain line indicates a biased light distributing characteristic according to the present invention, while a double-dotted chain line shows a distributing characteristic of general conventional lamp of the same shape, for mutual comparison;

FIG. 6 is a perspective view with a part removed of another lamp which can be used in the first embodiment of FIG. 1;

FIG. 7 is a cross sectioned view of the lamp shown in FIG. 6;

FIG. 8 is a perspective view with a part removed of another lamp which can be used in the embodiment of FIG. 1;

FIG. 9 is a sectioned view of the lamp shown in FIG. 8;

FIG. 10 is a perspective view of a second embodiment of the present invention wherein the permanent magnet is made rotatable while the lamp tube is fixed;

FIG. 11 is a sectioned elevation of the second embodiment of FIG. 10;

FIG. 12 is a plan view of a socket employed in the second embodiment;

FIGS. 13*a* to 13*c* are explanatory views for the operation of the second embodiment;

FIG. 14 is a sectioned elevation of a third embodiment of the present invention wherein the permanent magnet and lamp tube are both rotatable;

FIG. 15 is a sectioned elevation of a fourth embodiment of the present invention wherein the discharging space in the lamp tube is unequally divided and one of such divided spaces is selected to be utilized as a discharging zone by an electromagnetic means;

FIG. 16 is a sectioned view of the fourth embodiment of FIG. 15;

FIG. 17 is a sectioned elevation of a fifth embodiment of the present invention wherein a discharging zone biasing means which moves by its own weight or an external magnetic force is arranged in the lamp tube;

FIG. 18 is a horizontally sectioned view of the fifth embodiment;

FIG. 19 is a perspective view with a part removed of the lamp used in the fifth embodiment;

FIGS. 20*a* through 20*h* are operation explaining views of the fifth embodiment;

FIG. 21 is a sectioned elevation of another lamp usable in the fifth embodiment;

FIG. 22 is a cross sectioned view of the lamp shown in FIG. 21;

FIGS. 23*a* and 23*b* are operation explaining views of the lamp of FIG. 21;

FIG. 24 is a sectioned elevation of another lamp usable also in the fifth embodiment;

FIG. 25 is a cross sectioned view of the lamp of FIG. 24 wherein a cross-hatched portion is a discharging zone for explaining the operation of the lamp;

FIGS. 26*a* and 26*b* are views similar to FIG. 25 also for explaining the operation of the lamp of FIG. 24;

FIG. 27 is a sectioned elevation of another lamp which can be used in the fifth embodiment;

FIG. 28 is a horizontally sectioned view of the lamp shown in FIG. 27;

FIG. 29 is a perspective view with a part removed of still another lamp that can be used in the fifth embodiment;

FIGS. 30*a* through 30*d* are cross sectioned views of the lamp shown in FIG. 29 for explaining its operation;

FIG. 31 is a perspective view of a lamp provided with a means for improving biasing degree of the discharging zone in the lamp of the respective embodiments shown in FIGS. 1 through 30;

FIG. 32 is a sectioned elevation of a sixth embodiment of the present invention; and FIG. 33 is a cross sectioned view of the lamp used in the sixth embodiment of FIG. 32 wherein cross-hatched portion indicates a discharging zone for explaining its operation.

While the present invention shall now be explained in the followings with reference to the certain preferred embodiments shown in the drawings, the intention is not to limit the invention only to these particular embodiments but is to rather include all modifications, alterations and equivalent arrangements possible within the scope of appended claims.

Figure 3:
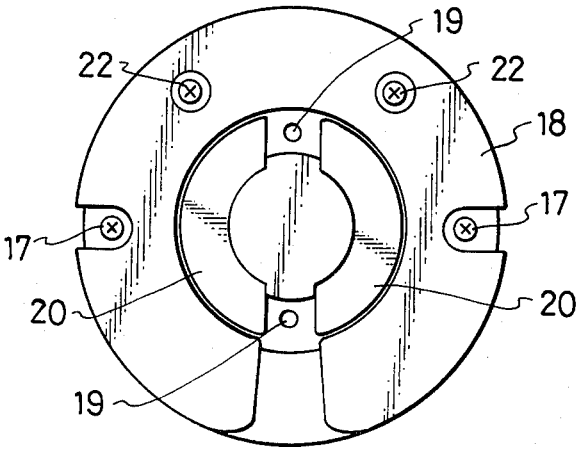
FIG. 3 is a front side plan view of a rotary socket utilized in the first embodiment.
Figure 4:
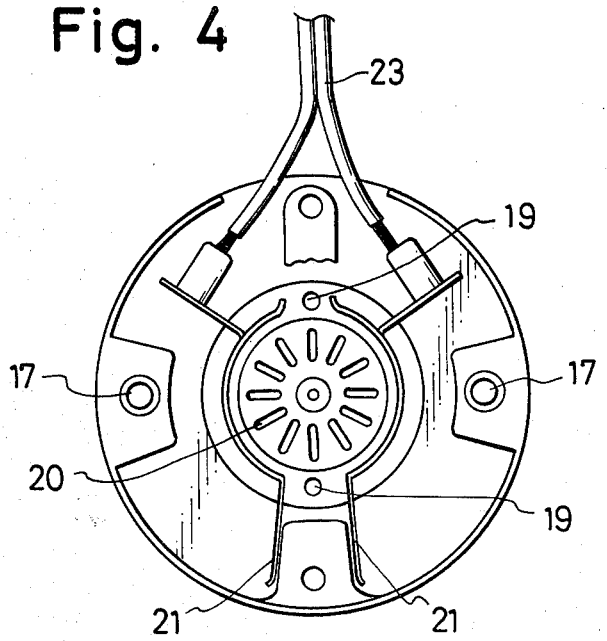
FIG. 4 is a reverse side plan view of the rotary socket in FIG. 3.

Referring now to the first embodiment shown in FIGS. 1 through 5, a lamp of a glass tube 1 is held at socket pins 2 and 3 of both longitudinal ends by rotary sockets 4 and 5 which are fitted respectively to each of both longitudinal ends of a base reflector 6 containing therein a stabilizer and the like. An elongated plate-shaped permanent magnet 7 is secured to the central lower surface of the reflector 6, that is, to the surface opposed to the lamp 1. The lamp 1 has stems 8 and 9 arranged at both ends inside the tube and these stems 8 and 9 are provided respectively with lead wires 10 and 11 as passed through the stems and connected to the socket pins 2 and 3. A filament 12 or 13 is arranged across the free ends of the lead wires 10 or 11, and an inner glass tube 14 of a smaller diameter than the lamp 1 and closed at both ends is arranged between the both filaments 12 and 13 so as to be, in the present instance, substantially coaxial with the outer positioned lamp tube 1, and the inner space of the lamp 1 is thus limited to be tubular around the inner tube 14. Further, the tube 14 is held at both ends to the stems 8 and 9 through supporters 15 and 16 made of a metal. The inner surface of the outer lamp tube 1 is circumferentially divided into three parts over the length of the lamp tube, as painted with such three different fluorescent materials as calcium halophosphate of a color temperature of 3000° K., calcium halophosphate of a color temperature of 4500° K. and calcium halophosphate of a color temperature of 6500° K. which are thereafter sintered, respectively as indicated by a, b and c in FIG. 5, while the outer surface of the inner tube 14 is coated with an ultraviolet ray reflecting film. The rotary sockets 4 and 5 are provided respectively with a base 18 secured to each socket with screws 17 and a rotary member 20 having holes 19 for inserting therethrough the socket pins 2 and 3 and axially rotatably engaged in the central part of the base 18 as seen in FIG. 3. While not shown, radial recesses are made in the reverse surface of the rotary member 20, which are engaged with projections provided at the opposed positions on the socket 4 or 5. On the reverse side of the respective sockets, as seen in FIG. 4, electric contactors 21 are provided so as to contact the socket pins 2 or 3 inserted through the holes 19 of the rotary member 20, as secured at their base to the base 18 with screws 22 and connected through cords 23 to an electric circuit of the stabilizer and the like within the reflector 6.

As shown in FIG. 5, the lamp 1 is disposed within the magnetic field of the permanent magnet plate 7 and the discharging zone in the lamp 1 is caused to be biased to such an area indicated by the cross-hatched portion as in FIG. 5, that is, the discharging is forcibly concentrated substantially in the particular area in which the magnetic field is weak. In the drawing, respective arrows of broken line indicate magnetic force lines produced by the permanent magnet 7, while the single-dotted chain line indicates an equal brightness plane and the double-dotted chain line indicates the similar plane in the case where the permanent magnet 7 and inner tube 14 are not present, that is, in the case when a conventional lamp is used. As evident from this, the lamp of this embodiment has a specific light distributing characteristic biased in the downward direction, that is, toward the opposite side of the permanent magnet. Upon an rotation of the lamp 1 in its circumferential direction, the color of emitted light can be varied from, for example, a white light emission of a color temperature of 4500° K. to a warmer white color emission of a color temperature of 3000° K. or to a daylight color emission of a color temperature of 6500° K., depending on a specific one of the different fluorescent materials opposed to the biased discharging zone as rotated with the lamp 1.

Next, the discharge lamp device of the present invention shall be explained by using more concrete numerical values. In FIGS. 1 to 5, the length of the lamp tube 1 was 600 m.m., the diameter of the tube was 38 m.m., the diameter of the inner tube 14 was 20 m.m. and the discharge was caused adjacent one of the divided parts of calcium halophosphate of the color temperature of 4500° K. In this case, the light pencil was 1500 lm and the light distribution ratio, that is, the ratio of the maximum distance to the minimum distance from the center of the lamp 1 to the equal brightness plane of the single-dotted chain line in FIG. 5 was 5. At this time, the lamp current was 0.4 A and the lamp voltage was 70 V. The permanent magnet 7 was of a shape of a cross-section of 10 m.m.×20 m.m. and length of 60 m.m. and was arranged as separated by 10 m.m. from the outer surface of the lamp 1. The magnetic flux density on the surface of the permanent magnet 7 was 300 gausses and that in the upper zone of the lamp 1, that is, the symmetrically opposing zone to the cross-hatched zone in FIG. 5 was 100 to 200 gausses, while the magnetic flux density in the lower zone of the lamp 1, that is, the cross-hatched zone in FIG. 5 was 0 to 50 gausses.

Further, the process for manufacturing the lamp 1 used in the discharge lamp device of the present invention shall be detailed to accelerate the understanding. In manufacturing the lamp 1 utilized in the embodiment shown in FIGS. 1 to 5, calcium halophosphate of the color temperature of 3000° K. is applied through a nozzle to one of the three divided parts of the inner surface of a glass tube and is dried, thereafter calcium halophosphate of the color temperature of 4500° K. is applied through another nozzle to next part and is dried, and finally calcium halophosphate of the color temperature of 6500° K. is applied to remaining part through still another nozzle and is dried. These three different calcium halophosphates will be arranged respectively in substantially equal zones on the inside surface of the glass tube while being somewhat overlapped with each other. Thereafter, the applied materials are baked and a fluorescent material film having three zones respectively extending along the axial direction of the glass tube will be formed on the inner surface of the tube, whereby the outer tube is prepared. Separately, the outer surface of the inner glass tube 14 closed at both ends and coupled to the supporters 15 and 16 is coated with an ultraviolet ray reflecting film. The stem 8 holding the filament 12 is fitted as sealed to one end of the outer tube having such fluorescent material film as above arranged on the inside surface. The inner glass tube 14 is inserted into the outer tube from the other end thereof so as not to contact the fluorescent material film and a guide ring part of the supporter 15 is applied to crown the stem 8. The stem 9 holding the filament 13 is fitted as sealed to the other end of the lamp tube 1 so as to be fitted to a guide ring part of the other supporter 16. Thereafter, air is discharged through the stems 8 and 9 to both ends out of the outer tube and predetermined amounts of a mercury vapor and a rare gas are enclosed in the outer tube, whereby the lamp 1 is manufactured.

In the embodiment of FIGS. 1 to 5, the glass tube 14 closed at both ends is used as a part of discharging zone biasing means, but it will be apparent that, even if such flat plate-shaped glass member 14A as shown in FIGS. 6 and 7 is employed as inserted into the lamp 1, substantially the same operation as in the case of the embodiment of FIGS. 1 to 5 can be achieved. In this case, it will be clear that two different fluorescent materials are applied and baked respectively on one half inner surface part of the tube and on both sides of the plate-shaped member 14A.

It will be also apparent that, in the first embodiment of FIGS. 1 to 5, even if the inner space of the lamp 1 is divided into three equal sections in the circumferential directions with such glass member 14B having three angled flat parts as shown in FIGS. 8 and 9 and a fluorescent material film presenting three different colors respectively applied to each of the three sections is formed on the inner surface, substantially the same operation as that of the first embodiment can be achieved.

In the above descriptions relative to FIGS. 1 to 9, an arrangement in which the permanent magnet is fixed and the lamp tube is rotated in the circumferential direction has been referred to. With this arrangement, it will be noticed that the light distributing direction itself is limited to a fixed direction, while the color can be varied selectively. The present invention suggests next in the followings an embodiment of a type in which the light distributing direction can be varied by allowing the permanent magnet to be rotated.

Referring now to FIGS. 10 to 13, a lamp 41 is held at both ends by sockets 44 and 45 respectively through socket pins 42 and 43. The sockets 44 and 45 are fitted to both ends of a reflector base 46 containing therein a stabilizer and the like necessary elements. An arcuate guide groove 47 or 48 is made in each of opposed surfaces of the sockets 44 and 45. Magnet holders 49 and 50 are arranged respectively in each of the guide grooves 47 and 48 and are held rotatably at the base of the holders by bearings 51 and 52. A permanent magnet 53 of an elongated plate shape is arranged between the free ends of the magnet holders 49 and 50 so that the magnet 53 can be moved around the lamp 41. Contactors 56 and 57 resiliently urged respectively against each of the socket pins 42 and 43 of the lamp which are inserted through holes 54 and 55 into the sockets 44 and 45 are arranged respectively within each of the sockets 44 and 45. The structure and manufacturing method of the lamp 41 are the same as those of the foregoing lamp 1 and will be readily understood, therefore, by those skilled in the art. In the present embodiment, on the other hand, the fluorescent material is uniformly applied on the inside surface of the lamp 41. As shown in FIG. 13*a*, if the permanent magnet 53 is positioned on one side surface of the lamp 41, the discharging zone will be positioned on the opposite side so as to provide such light distributing characteristic as indicated by the chain line. As shown in FIG. 13*b* next, the permanent magnet 53 rotated until it is positioned on the upper surface of the lamp 41 causes the discharging zone to be positioned on the underside to provide such light distributing characteristic as indicated by the chain line. As shown in FIG. 13*c*, further, the permanent magnet 53 rotated further to be positioned on the other side surface of the lamp 41 causes the discharging zone to be positioned on the opposite side to provide such light distributing characteristic as indicated by the chain line.

It will be apparent that, if the lamp 1 used in the first embodiment of FIGS. 1 to 5 is utilized in the present instance, a light of different colors can be provided depending on such variable light distributing direction.

It will be also apparent that even the lamp such as shown in FIGS. 6 and 7 or in FIGS. 8 and 9 can be employed effectively to provide a light of different colors with the variable light distributing direction in the same manner.

Further, in this second embodiment of FIGS. 10 to 13, it is made possible to vary the light distributing direction as well as the color depending on the variable light distributing direction. It will be apparent, however, that an employment of the rotary sockets of the first embodiment of FIGS. 1 to 5 in the second embodiment will enable the light distributing direction and color to be respectively independently variable. It will be of course necessary in this case to form different fluorescent material zones for presenting a plurality of colors on the inside surface of the lamp. The device in this case will be as shown in FIG. 14, wherein a lamp 61 of exactly the same structure as of the lamp 1 in the first embodiment of FIGS. 1 to 5 is held between rotary socket parts 65 and 66 of sockets 63 and 64 arranged at both ends of a reflector base 62 containing therein the stabilizer and the like. These rotary socket parts 65 and 66 are shown in section and recesses 71 and 72 made respectively in each of the back surfaces of rotary bodies 69 and 70 having holes in which socket pins 67 and 68 of the lamp 61 are inserted receive projections 73 and 74 arranged at opposed positions, magnet holders 75 and 76 are held rotatably at their base by bearings 77 and 78 and are extended at the free ends respectively out of the sockets 63 and 64 through arcuate guide grooves 79 and 80. A plate-shaped permanent magnet 81 is held between the free ends of the magnet holders 75 and 76, thus, to be rotatable about the lamp 61. The operation of this third embodiment shown in FIG. 14 will be almost self-explanatory and shall not be detailed here.

Referring next to FIGS. 15 and 16 showing another fourth embodiment of the present invention, a lamp 91 is held stationarily by conventional sockets 94 and 95 respectively through socket pins 92 and 93. A glass plate 100 is arranged as a discharging zone biasing means or, specifically in the present instance, as a separating the inner space of the lamp 91 into two, as extended between two positions respectively adjacent a filament 97 held by a stem 96 and a filament 99 held by a stem 98. The glass plate 100 is fused to the inside surface of the lamp 91 to divide the interior of the lamp 91 into a larger space and a smaller space. The inside surface of the lamp 91 is coated separately in the respective larger and smaller spaces with each of fluorescent materials presenting respectively different colors, which are, for example, zinc silicate presenting a green color emission and calcium tungstate presenting a blue color emission. Electromagnets 102 and 103 are arranged on a reflector base 101 having the sockets 94 and 95 and containing therein such necessary circuit elements as a stabilizer and the like. As will be clear from FIG. 15, the electromagnets 102 and 103 are arranged close to the outside of the lamp 91 on the side of the larger space and adjacent the filaments 97 and 99. When the electromagnets 102 and 103 are not excited, the larger space in the lamp 91 will be naturally the discharging zone so that the light distributing direction will be upward and will provide an indirect illumination in case the lamp is arranged on a ceiling or wall. On the other hand, when the electromagnets 102 and 103 are excited by a remote switch arranged on a wall surface or the like, the discharging zone will be magnetically biased to the side of the smaller space in the lamp 91, so that the light distributing direction will be downward and will be provide a direct illumination. As will be evident from the above description, in this fourth embodiment, the color can be made different by the light distributing direction. If the color variation is not desired, a common fluorescent material may be applied to the inside surface of the lamp over the both larger and smaller spaces.

In the fourth embodiment of FIGS. 15 and 16, the flat plate-shaped glass plate 100 is employed as the discharging zone biasing means or separator inside the lamp 91 to divide the interior of the lamp 91 into the two larger and smaller spaces. However, it will be apparent that not only the flat plate-shaped glass plate but also a glass cylinder closed at both ends may be employed as eccentrically arranged in the lamp or a spacer of any other desired shape may be employed. In short, it will be apparent that, so far as the member 100 has a structure which can divide the interior of the lamp into the larger and smaller spaces.

Referring now to another fifth embodiment of the present invention shown in FIGS. 17 to 20 a lamp 111 is provided with a movable glass plate 116 arranged between respective a filaments 113 and 115 which are held by stems 112 and 114. The glass plate 116 is held slidably in a pair of guide members 117 and 118 extended and fixed at both ends in the diametral direction and the plate 116 caries magnetic members 119 and 120 respectively secured adjacent each of both longitudinal ends. The inside surface of the lamp 111 is divided into four sections $a_1$, $b_1$, $c_1$ and $d_1$ separated in the circumferential directions as coated with such four different fluorescent materials as magnesium fluorogermanate presenting a red color emission, a mixture of a calcium halophosphate and zinc silicate presenting a yellow color emission, zinc silicate presenting a green color emission and calcium tungstate presenting a blue color emission. The lamp 111 is held by rotary sockets 123 and 124 respectively through socket pins 121 and 122 at the both ends of the lamp. The structure of the rotary sockets 123 and 124 is the same as that explained for the respective embodiments of FIGS. 1 to 5 and FIG. 14 and will not be required to be explained here. Electromagnets 125 and 126 are arranged near the upper surface of the lamp 111, that is, near the upper surface in the direction of gravity so as to lower the impedance on the side of the lower surface, opposite to the electromagnets, of the glass plate 116, to thereby render the discharging zone to be easily biased or, in other words, to elevate the easiness of achieving the discharging zone concentratively on the lower surface side of the glass plate 116 (the term "impedance" shall be used hereinafter in this meaning). Further electromagnets 127 and 128 are arranged near the other lower surface of the lamp 111, that is, near the lower surface in the direction of gravity to lower the impedance on the side of the upper surface of the glass plate 116 to thereby bias the discharging zone on the upper surface side of the plate. In the present embodiment, further two pairs of electromagnets 129, 130 and 131, 132 are arranged respectively near each of both lateral side surfaces of the lamp 111 to attract the magnetic members 119 and 120 on the plate 116 so as to move the plate in the horizontal directions, as seen in the bottom view of FIG. 18. A reflector base 133 is provided with the rotary sockets 123 and 124 at both ends and further with holders 134 and 195 for the respective pairs of electromagnets 125 to 132. It will be apparent that a necessary circuit of a stabilizer and the like is contained in the reflector base 133.

Figure 20A:
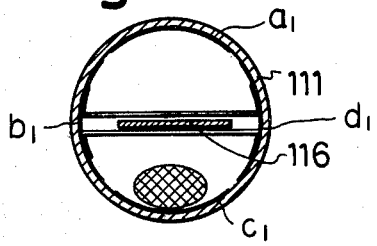
Figure 20B:
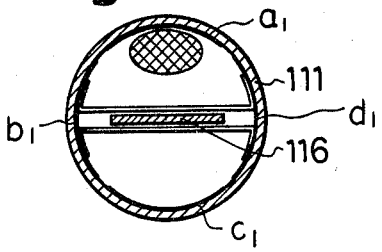
Figure 20C:
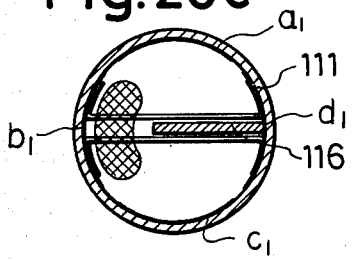
Figure 20D:
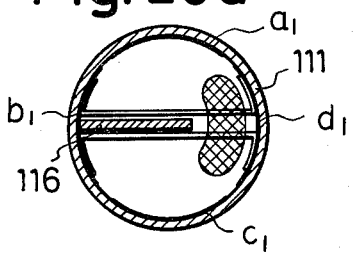

Referring to the operation of the fifth embodiment shown in FIGS. 17 to 20, the lamp 111 is axially rotated so that the glass plate 116 in the lamp 111 is in the horizontal position, the pair of electromagnets 125 and 126 on the upper side are kept excited by a remote switch (not illustrated) arranged, for example, on a wall surface or the like, a discharging zone is formed in the position indicated by a cross-hatched area shown in FIG. 20*a* so that a light distributing characteristic biased in the downward direction can be attained. It will be apparent that, at this time, a color corresponding to either of the sections $a_1$ and $c_1$ can be attained. When the lower side pair of electromagnets 127 and 128 are kept excited by a remote switch (not illustrated) installed, for example, on a wall surface or the like, the discharging zone is formed in the position indicated by the cross-hatched area of FIG. 20*b* and a light distributing characteristic biased in the upward direction can be attained. At this time, a color corresponding to either of the sections $a_1$ $c_1$ can be attained. When the lateral side pair of electromagnets 129 and 130 are excited by a remote switch (not illustrated) arranged on a wall surface or the like, the magnetic members 119 and 120 on the plate 116 are attracted and the glass plate 116 is moved to one end of the guide members 117 and 118. Even if the excitation of the electromagnets 129 and 130 is stopped, the discharging zone will be formed in the position indicated by the cross-hatched area as in FIG. 20*c* and a light distributing characteristic biased in the leftward direction in FIG. 20*c*, that is, in the direction behind the paper of FIG. 17 can be attained. In this case, a color tones corresponding to either the sections $b_1$ and $d_1$ will be able to be attained. When the other lateral side pair of electromagnets 131 and 132 are excited by a similar remote switch, the magnetic members 119 and 120 are attracted and the glass plate 116 is moved to the other ends of the guide members 117 and 118. Even if the excitation of the electromagnets 131 and 132 is stopped, the discharging zone will be formed in the position indicated by the cross-hatched area in FIG. 20*d* and a light distributing characteristic biased in the rightward direction in FIG. 20*d*, that is, in the direction in front of the paper surface of FIG. 17 will be attained, in which event a color corresponding to the other one of the sections $b_1$ and $d_1$ will be attained.

Figure 20E:
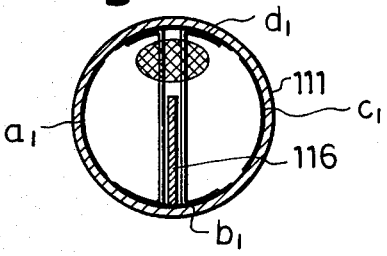
Figure 20F:
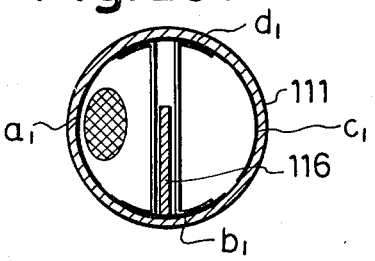
Figure 20G:
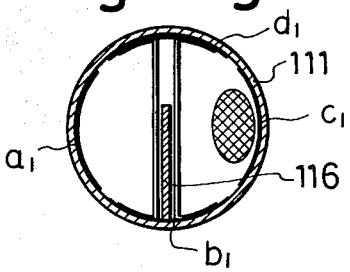
Figure 20H:
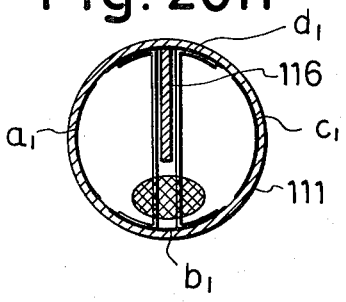

The case where the lamp 111 is rotated so that the glass plate 116 in the lamp 111 is positioned in the vertical direction shall be explained. The glass plate 116 is positioned at the lower ends of the guide members 117 and 118 by its own weight as shown in FIG. 20*e*. Then, even when none of the electromagnets 125 to 132 is excited, the discharging zone will be formed in the position indicated by the cross-hatched area in FIG. 20*e*, a light distributing characteristic biased in the upward direction, that is, in the direction against the gravity can be attained, and a color corresponding to the either of the sections $b_1$ and $d_1$ can be attained. As one of the lateral side pairs of the electromagnets 129 and 130 are excited, the discharging zone will be formed in the position indicated by the cross-hatched area in FIG. 20*f* and a light distributing characteristic biased in the leftward direction in the drawing, that is, in the direction in front of the paper surface of FIG. 17 can be attained, in which event a color corresponding to either one of the sections $a_1$ and $c_1$ can be attained. When the electromagnets 131 and 132 are excited, the discharging zone will be formed in the position indicated by the cross-hatched area of FIG. 20*g* and a light distributing characteristic biased in the rightward direction in FIG. 20*g*, that is, in the direction in front of the paper surface of FIG. 17 can be attained, in which case a color corresponding to the other one of the sections $a_1$ and $c_1$ can be attained. Further, when the upper side electromagnets 125 and 126 are excited in this state, the magnetic members 119 and 120 are attracted, the glass plate 116 is moved to the upper ends of the guide members 117 and 118 against the gravity and, therefore, the discharging zone will be formed in the lower position indicated by the cross-hatched area in FIG. 20*h*, whereby a light distributing characteristic biased in the downward direction in FIG. 20*h*, that is, in the gravitational direction can be attained. At this time, a color corresponding to one of the sections $b_1$ and $d_1$ can be attained.

While the references have been made with respect to the embodiment of FIGS. 17 to 20 to the electromagnets which are arranged respectively adjacent both ends of the lamp 111, it will be apparent that, even when a permanent magnet is arranged rotatable around the lamp 111 arranged stationary as in the case of the second embodiment shown in FIGS. 10 to 13, the lamp can be operated in the same manner as in the foregoing and that, even if the permanent magnet is rotated around the lamp 111 and also the lamp 111 is made circumferentially or axially rotatable as in the third embodiment shown in FIG. 14, substantially the same operation can be achieved.

It will be also apparent that, in the fifth embodiment of FIGS. 17 to 20, the lamp 111 may be replaced by such a lamp 111A as shown in FIGS. 21 to 23, the electromagnets 125 to 128 may not be excited or even omitted, and the present invention still can be well achieved. In the lamp 111A, a glass plate 116A acting as a discharging zone biasing means or separator is locked through locking members 117A' and 118A' to holding members 117A and 118A secured as fused to the inside surface of the lamp 111A. The glass plate 116A is extended at both longitudinal ends close to filaments 113A and 115A and is provided adjacent the both ends with magnetic members 119A and 120A. When the one lateral side pair of the electromagnets 131 and 132 in the fifth embodiment are excited, the glass plate 116A is locked to incline on one lateral side against the gravity as shown in FIG. 23*a* and the discharging zone is caused to exist as biased on the other lateral side as indicated by the cross-hatched area, whereby a light distributing characteristic biased in the right downward direction in FIG. 23*a* can be attained. As will be evident, the other lateral side pair of the electromagnets 129 and 130 excited cause the plate 116A to operate the same as above but in the opposite direction to cause the discharging zone to exist on the other lateral side as indicated by the cross-hatched area in FIG. 23*b*, whereby a light distributing characteristic biased in the left downward direction in the drawing will be attained. If fluorescent materials emitting lights of different colors are arranged in the divided sections $a_2$ and $b_2$ as seen in FIG. 22 on the inside surface of the lamp 111A, such variation in the light distributing direction as above will result in the variation in the color.

In the fifth embodiment of FIGS. 17 to 20*h*, further, the lamp 111 may be replaced by such a lamp 111B as shown in FIGS. 24 to 26 so as to also well realize the present invention. In the lamp 111B, a glass made cylinder 116B acting as a discharging zone biasing means or separator and closed at both ends is arranged, as eccentrically held by a shaft 117B axially rotatably arranged across opposing stems 112B and 114B at both ends of the lamp 111B so as to extend close to filaments 113B and 115B held by the stems 112B and 114B, and this cylinder 116B is provided at both ends with magnetic members 119B and 120B which are preferably of a wire wound on the cylinder. When the upper side pair of the electromagnets 125 and 126 in the fifth embodiment are excited, as shown in FIG. 26*a*, the glass cylinder 116B will move to its uppermost position and discharging zone is caused to exist in the cross-hatched area and the light distributing characteristic will be in the downward direction. When the lateral side pair of the electromagnets 129 and 130 are excited, as shown in FIG. 26*b*, the glass cylinder 116B will be in the same lateral side position and the discharging zone will be on the other lateral side indicated by the cross-hatched area as in FIG. 26*b*. It will be apparent that an excitation of the other lateral side electromagnets 131 and 132 will result in an operation opposite to that of FIG. 26*b*. When none of the electromagnets 125 through 132 is excited, the discharging zone will be porduced in the area indicated by the cross-hatched section as in FIG. 25. It will be apparent that, if fluorescent materials of different colors are provided on the inside surface of the lamp 111B, not only the light distributing characteristic but also the color can be properly varied.

It will be almost self-evident that, even if the lamp 111A shown in FIGS. 21 to 23 and the lamp 111B shown in FIGS. 24 to 26 are exchanged for the lamp 1 in FIGS. 1 to 5, the lamp 41 in FIGS. 10 to 13, the lamp 61 in FIG. 14 and the lamp 91 in FIGS. 15 and 16, the present invention can be realized in the same manner.

In the fifth embodiment shown in FIGS. 17 to 20, even if the lamp 111 is replaced by such a lamp 111C as shown in FIGS. 27 and 28, the present invention can be likewise realized. In the lamp 111C, a glass plate 116C acting as a discharging zone biasing means or a separator is arranged between two positions adjacent respective filaments 113C and 115C and is supported at both ends by holders 117C and 118C fixed across the inside surface of the lamp 111C. A semicircular closing plate 117C' having at least a magnetic material is pivoted to the holder 117C to be rotatable about its diametral edge. When the lamp 111C is disposed so that the glass plate 116C is horizontal, the closing plate 117C' is pivotally inclined downward due to its own weight as seen in FIG. 27 and the upper side of the glass plate 116C will be the discharging zone. When the electromagnet 125 is excited, the closing plate 117C' will be lifted against the gravity to close the upper side of the glass plate 116C and the lower side of the plate will be the discharging zone. On the other hand, when the lamp 111C is arranged so that the glass plate 116C is vertically erected and, when the one lateral side electromagnet 129 as in the fifth embodiment is excited, the discharging zone will be produced on the side of the opposite lateral side electromagnet 131 and, when the electromagnet 131 is excited, the discharging zone will be produced on the side of the electromagnet 129, whereby a proper light distributing characteristic will be able to be realized. Further, if the inside surface of the lamp 111C is painted with fluorescent materials of different colors with the glass plate 116C as a boundary, the color can be also varied selectively.

It will be self-evident that, even if the lamp 111C shown in FIGS. 27 and 28 is replaced by the lamp 1 in FIGS. 1 to 5, the lamp 41 in FIGS. 10 to 13, the lamp 61 in FIG. 14 or the lamp 91 in FIGS. 15 and 16, the present invention can be similarly effectively realized.

The present invention can be also realized even when the lamp 111 in the fifth embodiment of FIGS. 17 to 20 is replaced by such a lamp 111D as shown in FIGS. 29 to 30. In this lamp 111D, a glass plate 116D performing the function of the discharging zone biasing zone or inside-space separator is disposed substantially between the both filaments 113D and 115D. To the both lengthwise ends of this plate 116D, holders 117D and 118D are secured at their inner end, and rings 117D' and 118D' to be freely loosely engaged to both end stems 112D and 114D are secured to the other outer ends of the holders. In the present instance, the holders 117D and 118D and rings 117D' and 118D' are made of a magnetic material. The rings 117D' and 118D' are of a diameter larger than that of the stems at their portion with which the rings are to engage, so that, when the lamp 111D is disposed to cause the plate 116D to lie horizontal, the plate itself is positioned in a lower half space in the lamp 111D as shown in FIG. 30*a*, whereby the impedance in the other upper half space inside the lamp is made lower than that in the upper half space and the discharging zone is biased to exist in the upper space as shown by the cross-hatched area in FIG. 30*a*. In this case, an inside surface region denoted by $a_3$ in the upper half space of the lamp 111D is coated with calcium halophosphates of a color temperature of 3000° K. so that, when the light distributing characteristics biased in the upward vertical direction, a light colored by the fluorescent material applied and baked on the section $a_3$ will be emitted. When the upper side electromagnets 125 and 126 as in the fifth embodiment are excited, the holders 117D and 118D are attracted thereto so that the plate 116D will be positioned in the upper half space as shown in FIG. 30*b*, whereby the impedance in the lower half space is lowered to be less than that in the upper half space and the discharging zone is biased to be in the lower half space as shown by the cross-hatched area in FIG. 30*b*. As an inside surface region of this lower half space shown by $b_3$ in the drawing is coated with calcium halophosphate of a color temperature of 4500° K., a light biased in the vertically downward direction and colored by such fluorescent material as just referred to can be emitted. As will be now clear, the regions $a_3$ and $b_3$ can be reversed to each other by an axial rotation of the lamp 111D so that the light distribution can be varied to be vertically upward or downward with each of the different colors.

Figure 30A:
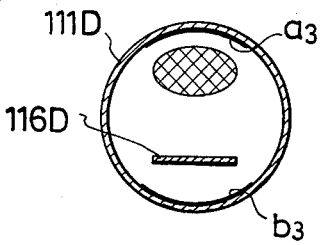
Figure 30B:
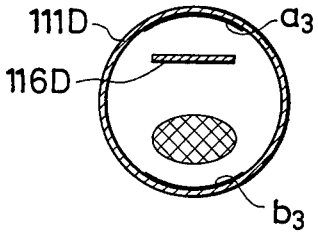
Figure 30C:
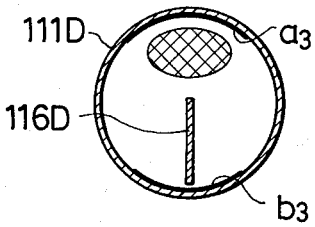
Figure 30D:
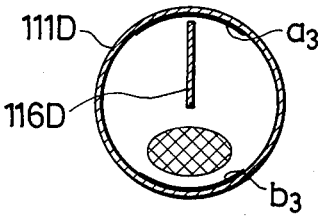

When the lamp 111D is arranged so as to dispose the glass plate 116D to be vertically erected, the plate is to be also positioned in the lower half space of the lamp thus positioned because of the loose engagement of the rings 117D' and 118D', whereby the impedance is lowered in the upper half space as compared with the lower half space and the discharging zone is biased to the cross-hatched area shown in FIG. 30*c*. With the coating of the fluorescent material in the same region $a_3$ as in FIG. 30*a*, the light distribution biased in the vertically upward and colored by the particular fluorescent material of the region $a_3$ can be obtained. When the upper side electromagnets 125 and 126 are excited in this state, next, the magnetic holders 117D and 118D are attracted upward so as to dispose the plate 116D in the upper half space as shown in FIG. 30*d*, whereby the impedance in the lower half space is lowered this time and the discharging zone is biased to be in the lower half space as shown by the cross-hatched area in FIG. 30*d*. As the lower half region denoted by $b_3$ in the drawing is coated with a different fluorescent material, a light biased in vertically downward direction and colored differently by the fluorescent material of the region $b_3$ can be achieved. An axial rotation of the lamp 111D in this case will allow the color region $a_3$ or $b_3$ to be reversed so that any desired one of combinations of the respective vertically different light distributions and the respective different colors.

Thus, it will be apparent that any one of variable light distributions may be optionally obtained when the lamp 111D is rotated, the glass plate 116D is varied in the inclined direction with respect to the direction of gravity, or any one or ones of the electromagnets 129 through 132 is excited. In this case, the inside surface of the lamp 116D may be coated with different fluorescent materials providing different colors on the respective divided regions of the lamp, so that a light of any one of desired colors can be selectively obtained.

It will be also apparent that the lamp 111D shown in FIGS. 29 and 30 may be replaced by any one of the lamp 1 of FIGS. 1 to 5, the lamp 41 of FIGS. 10 to 13, the lamp 61 of FIG. 14 and the lamp 91 of FIGS. 15 and 16 to achieve the same effects of the invention.

In order to improve the biasing degree of the discharging zone in the respective embodiments of FIGS. 1 through 30, it is only necessary that the magnetic flux density only at a part in the cross-section of the lamp is increased. For this purpose, for example, the permanent magnets 7, 53 and 81 may be formed, for example, as denoted by 7A in FIG. 31, in which the respective permanent magnets 7A of each set is arranged with the different poles opposed to each other on the upper edge part of the lamp 1.

FIGS. 32 and 33 show a further sixth embodiment of the present invention. In this embodiment, such adjacent conductors as, for example, transparent conductive films 142 to 145 extended in the lengthwise direction of a lamp 141 and are formed on the outside surface of the lamp 141 so as to be extended close to the both ends of the lamp tube, that is, to the positions adjacent both end filaments 148 and 149 held by stems 146 and 147. Within the lamp 141, glass plates 150 acting as discharging zone biasing means or, rather, as space separators are arranged to divide the internal space in the circumferential directions to correspond to the adjacent conductors 142 to 145. Socket pins 151 and 152 of the lamp 141 are inserted in and engaged with the respective rotary sockets 153 and 154. A rotatable and cylindrical intermediate connector 155 is arranged on the fixing side of the rotary socket 153 and is extended on the free end side close to the filament 148 of the lamp 141. An annular conductor 156 circumferentially extending is arranged on the inside surface of the base end part of the intermediate connector 155 and has an annular guide groove 157 made in it to guide the base end of a connecting conductor 158. A hole in which one of the socket pins 151 is inserted is made at the other end of the connector 158. An annular conductor 156 is axially extended in a part to the inside surface of the intermediate connector 155 and has a brush 159 contacting the adjacent conductors 142 to 145 arranged at the end. The rotary sockets 153 and 154 are fitted on the fixing sides to a reflecting plate 160 containing therein a necessary circuit of a stabilizer and the like.

When the intermediate connector 155 is rotated 180 degrees from the position of FIG. 32, the brush 159 contacts the lowermost positioned conductor 144. With a voltage applied to this conductor 144 and filaments 148 and 149, the discharging zone is biased to be in one of the inner spaces divided by the separator 150 and closest to the conductor 144 due to the electric field generated by the voltage applied to the conductor 144 and the filaments. Once the discharging zone is formed, it will be kept until the current source is cut off. Therefore, the discharging zone will be formed in the particular zone indicated by the cross-hatched area in FIG. 33 and a light distributing characteristic biased in the downward direction will be realized. In order to vary the light distributing direction, the intermediate connector 155 is rotated to contact the brush 159 with another adjacent conductor, for example, 143 and then the current source is once cut off and put in again. It will be apparent here that, after the discharging zone is once formed, the lamp 141 itself may be rotated. It will be also evident that, if the inside surface of the lamp 141 divided with the glass plates 150 is coated with fluorescent materials presenting respectively different colors, desired light distributing characteristics and desired color can be respectively independently attained.

While, in the foregoing descriptions, it has been explained that means for biasing the discharging zone or for separating the inside space of the lamp into more than two for the biasing is formed of glass, it will be apparent that it may be formed of ceramics or the like. The means has been also referred to as being coated with an ultraviolet ray reflecting material, it will be also evident that a proper fluorescent material may be employed. Further, various types of the biasing or separating means may be freely employed, a required number of fluorescent materials may be applied on the inside surface of the lamp for different colors, and the type of the lamp may not only be the type of opposed filaments but also any of all types suggested today and in the future.

Further, while the embodiments in which, in order to vary the color, the inside surface of the lamp is painted with different fluorescent materials have been referred to, it will be apparent that different color filters or the like may be employed as arranged outside the lamp.

What is claimed as our invention is:

1. A discharge lamp device including a lamp mounted to a socket means and having a coating of fluorescent material on the inside surface, said device comprising means for biasing a discharging zone generated inside said lamp to an area of a certain angle of rotation about the axis of the lamp, and means for shifting said biased discharging zone in circumferential directions with respect to the lamp axis, said biasing means comprising a magnetic field applied from the exterior to said lamp for rendering the magnitude of magnetism to be nonuniform in the section of the lamp, said biasing means further comprising a space separator disposed inside said lamp.

2. The device according to claim 1 wherein said shifting means comprises a means for varying the magnitude of said magnetic field in the circumferential directions with respect to the lamp axis.

3. The device according to claim 1 wherein said biasing means comprises a permanent magnet locally disposed around said lamp, and said shifting means comprising means for displacing said permanent magnet around the lamp.

4. The device according to claim 2 wherein said magnetic field is generated by an electromagnet locally disposed around said lamp, and said magnitude varying means controls an excitation and non-excitation of said electromagnet.

5. The device according to claim 1 wherein said shifting means varies the orientation of said magnetic field.

6. The device according to claim 5 wherein said magnetic field is generated by a permanent magnet locally disposed around said lamp.

7. The device according to claim 5 wherein said magnetic field is generated by an electromagnet locally disposed around said lamp, and said orientation varying means controls an excitation and non-excitation of said electromagnet.

8. The device according to claim 1 wherein said shifting means is operably connected to said separator for moving the same.

9. The device according to claim 8 wherein said shifting means comprises a magnetic member provided on said separator and a means disposed around said lamp for magnetically attracting said magnetic member.

10. The device according to claim 9 wherein said magnetically attracting means is a permanent magnet disposed movable around said lamp.

11. The device according to claim 8 wherein said shifting means comprises a magnetic member disposed on said separator and an electromagnet disposed around said lamp for attracting said magnetic member.

12. The device according to claim 11 wherein said electromagnet is controlled to be excited and non-excited.

13. The device according to claim 9 wherein said separator comprises a flat plate member extended substantially between respective opposing filaments at both ends in said lamp and a closing plate pivotably secured to a longitudinal end of said plate member and carrying a magnetic member, said closing plate closing one of spaces in the lamp on both surfaces of the plate member upon said magnetic attraction.

14. The device according to claim 9 wherein said separator comprises a flat plate member extending substantially between respective opposing filaments at both ends in said lamp and pivotably secured along an extended edge to the inside surface of the lamp.

15. The device according to claim 9 wherein said separator comprises a cylindrical member closed and eccentrically pivotably supported at both axial ends between opposing stems for said filaments of said lamp.

16. The device according to claim 9 wherein said separator comprises a flat plate member extending substantially between respective opposing filaments at both ends in said lamp and holding members of a magnetic material respectively secured at one end to each longitudinal end of said plate member and loosely engaged to each of opposing stems for said filaments of said lamp.

17. The device according to claim 1 wherein said lamp is provided on a peripheral surface with color determining members respectively providing a different color from adjacent one of said members.

18. The device according to claim 17 wherein said color determining members are different fluorescent materials applied and baked onto the inner periphery of said lamp.

19. The device according to claim 17 wherein said color determining members are differently colored filters disposed on the outer periphery of said lamp.

20. The device according to claim 1 wherein said separator is provided on the surfaces with an ultraviolet ray reflecting member applied and baked onto the surfaces.

21. The device according to claim 1 wherein said separator is provided on the surfaces with a fluorescent material applied and baked onto the surfaces.

22. A discharge lamp device including a lamp mounted to a socket means and having a coating of fluorescent material on the inside surface, said device comprising means for biasing a discharging zone generated inside said lamp to an area of a certain angle of rotation about the axis of the lamp, and means for shifting said biased discharging zone in circumferential directions with respect to the lamp axis, said biasing means comprising a separator disposed within said lamp, said shifting means comprising a movable member provided to said separator such that said separator is shifted in response to movement of said movable member.

23. The device according to claim 22 wherein said separator is a flat plate member extending substantially between opposing filaments at both end of said lamp, and said movable member comprises a guide member allowing said plate member to move with its own weight, a magnetic member provided on the plate member and a means disposed outside the lamp for magnetically attracting said magnetic member to cause the plate member moved along said guide member against said weight.

24. The device according to claim 22 wherein said separator is a flat plate member extending substantially between opposing filaments at both ends of said lamp and a closing plate pivoted to an end of said plate member, and said movable member comprises a magnetic member provided on said closing plate and a means disposed outside the lamp for magnetically attracting said magnetic member to close one of both side spaces of the plate member in the lamp with the closing plate.

25. The device according to claim 22 wherein said separator is a flat plate member extending substantially between opposing filaments at both ends of said lamp and pivotably secured to the inner surface of the lamp along an extending side edge, and said movable member comprises a magnetic member provided on said plate member and a means disposed outside the lamp for magnetically attracting said magnetic member to rotate the plate member.

26. The device according to claim 22 wherein said separator comprises a cylindrical member closed and eccentrically pivotably supported at both ends of said member between opposing stems for filaments at both ends of said lamp, and said movable member comprises a magnetic member provided on said cylindrical member and a means disposed outside the lamp for magnetically attracting said magnetic member to move the cylindrical member.

27. The device according to claim 22 wherein said separator comprises a flat plate member extending substantially between opposing filaments at both ends of said lamp and holders respectively secured at one end of each longitudinal end of said plate member and loosely engaged at the other end to each of opposing stems for said filaments, and said movable member comprises a magnetic member forming at least a part of said holder and a means disposed outside the lamp for magnetically attracting said magnetic member to move the plate member.

28. The device according to claim 22 wherein said separator comprises a flat plate member extending substantially between opposing filaments at both ends of said lamp and holders respectively secured at one end to each longitudinal end of said plate member and loosely engaged at the other end to each of opposing stems for said filaments to allow the plate member to move with its own weight eccentrically with respect to the axis of the lamp.

29. A discharge lamp device including a lamp mounted to a socket means and having a coating of fluorescent material on the inside surface, said device comprising means for biasing a discharging zone generated inside said lamp to an area of a certain angle of rotation about the axis of the lamp, and means for shifting said biased discharging zone in circumferential directions with respect to the lamp axis, said shifting means comprising means for axially rotatably holding said lamp.

30. The device according to claim 29 wherein said rotatably lamp holding means comprises a rotary socket.

31. A discharge lamp device including a lamp mounted to a socket means and having a coating of fluorescent material on the inside surface, said device comprising means for biasing a discharging zone generated inside said lamp to an area of a certain angle of rotation about the axis of the lamp, and means for shifting said biased discharging zone in circumferential directions with respect to the lamp axis, said socket means comprising a pair of socket pins, said biasing means comprising a separator disposed within said lamp, said biasing means further comprising a neighboring conductor member disposed along the periphery of said lamp and connected at one end to one of said socket pins, and shifting means comprising means for temporarily interrupting the applied voltage between opposing filaments at both ends of the lamp.

* * * * *